US009380902B2

(12) United States Patent
Kirkwood

(10) Patent No.: US 9,380,902 B2
(45) Date of Patent: Jul. 5, 2016

(54) HANGER ACCESSORY DEVICE

(71) Applicant: David S. Kirkwood, Pittsburgh, PA (US)

(72) Inventor: David S. Kirkwood, Pittsburgh, PA (US)

( * ) Notice: Subject to any disclaimer, the term of this patent is extended or adjusted under 35 U.S.C. 154(b) by 0 days.

(21) Appl. No.: 14/593,025

(22) Filed: Jan. 9, 2015

(65) Prior Publication Data

US 2015/0201782 A1 Jul. 23, 2015

Related U.S. Application Data

(60) Provisional application No. 61/929,381, filed on Jan. 20, 2014.

(51) Int. Cl.
*A47G 25/14* (2006.01)
*A47G 25/32* (2006.01)

(52) U.S. Cl.
CPC ..... *A47G 25/1428* (2013.01); *A47G 25/1421* (2013.01); *A47G 25/32* (2013.01)

(58) Field of Classification Search
CPC ..... A47G 25/1407; A47G 25/1414; A47G 25/1428; A47G 25/1421; A47G 25/32; A47F 7/19; A41D 27/22
See application file for complete search history.

(56) References Cited

U.S. PATENT DOCUMENTS

| | | | | |
|---|---|---|---|---|
| 1,544,844 | A * | 7/1925 | Levkowits | A47G 25/1428 40/5 |
| 1,575,775 | A * | 3/1926 | Lesser | A47G 25/1428 223/92 |
| 2,610,077 | A * | 9/1952 | Swanson | B43K 23/00 401/34 |
| 3,124,284 | A | 3/1964 | Collum | |
| 3,262,425 | A * | 7/1966 | Waugh | B43K 29/02 15/431 |
| 3,898,754 | A | 8/1975 | Johansson | |
| 4,045,899 | A * | 9/1977 | Richardson | A47G 25/1428 116/200 |
| 4,123,864 | A | 11/1978 | Batts | |
| 4,198,773 | A | 4/1980 | Batts | |
| 4,221,298 | A * | 9/1980 | Wright | E05B 69/006 211/4 |
| 4,679,340 | A | 7/1987 | Johansson | |
| 4,756,104 | A | 7/1988 | Bailey | |
| 4,886,010 | A | 12/1989 | Stutzman | |
| 5,499,466 | A | 3/1996 | House | |
| 5,564,361 | A | 10/1996 | Satterwhite | |
| 5,586,697 | A | 12/1996 | Johansson | |
| 5,848,729 | A | 12/1998 | Thornton | |
| 6,330,969 | B1 | 12/2001 | Villaraut | |
| 6,883,259 | B2 | 4/2005 | Johansson | |
| 7,246,730 | B2 | 7/2007 | Russo | |
| 7,334,359 | B1 | 2/2008 | Palmer | |
| 8,069,595 | B2 | 12/2011 | Aiezza | |
| 8,627,584 | B2 | 1/2014 | Aiezza | |
| 2010/0077640 | A1 | 4/2010 | Randall | |
| 2011/0179681 | A1 | 7/2011 | Lamers | |

FOREIGN PATENT DOCUMENTS

| | | | |
|---|---|---|---|
| JP | 2006223795 | A * | 8/2006 |

* cited by examiner

*Primary Examiner* — Ismael Izaguirre
(74) *Attorney, Agent, or Firm* — Neustel Law Offices; Jason L. Gilbert

(57) ABSTRACT

A Hanger Accessory Device for keeping track of how many times an article of clothing has been worn since it was last laundered. The Hanger Accessory Device generally includes a housing having an upper end, a lower end, and a receiver opening extending therebetween. The upper portion of the outer surface of the housing includes first markings and the lower portion of the outer surface of the housing includes second markings. By rotating the housing (and thus the outwardly-facing markings) around a stem of a hanger, an individual may keep track of how many times an article of clothing has been worn or used between washings.

18 Claims, 11 Drawing Sheets

HANGER ACCESSORY DEVICE

CROSS REFERENCE TO RELATED APPLICATIONS

I hereby claim benefit under Title 35, United States Code, Section 119(e) of U.S. provisional patent application Ser. No. 61/929,381 filed Jan. 20, 2014. The 61/929,381 application is currently pending. The 61/929,381 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a hanger timer and more specifically it relates to a Hanger Accessory Device for keeping track of how many times an article of clothing has been worn since it was last laundered.

2. Description of the Related Art

Any discussion of the related art throughout the specification should in no way be considered as an admission that such related art is widely known or forms part of common general knowledge in the field.

Clothes hangers have been in use for many decades. Current clothes hangers provide no means for those who use them to keep track of how many times they've worn their clothing since it was last laundered or dry-cleaned. This can be a problem for individuals without the means or desire to wash clothing each time it is worn. For example, pants need not necessarily be washed every time they are worn, and would benefit from a more routine schedule.

Because of the inherent problems with the related art, there is a need for a new and improved Hanger Accessory Device for keeping track of how many times an article of clothing has been worn since it was last laundered.

BRIEF SUMMARY OF THE INVENTION

The invention generally relates to a clothes hanger accessory which includes a housing having an upper end, a lower end, and a receiver opening extending therebetween. The upper portion of the outer surface of the housing includes first markings and the lower portion of the outer surface of the housing includes second markings. By rotating the housing (and thus the outwardly-facing markings) around a stem of a hanger, an individual may keep track of how many times an article of clothing has been worn or used between washings.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
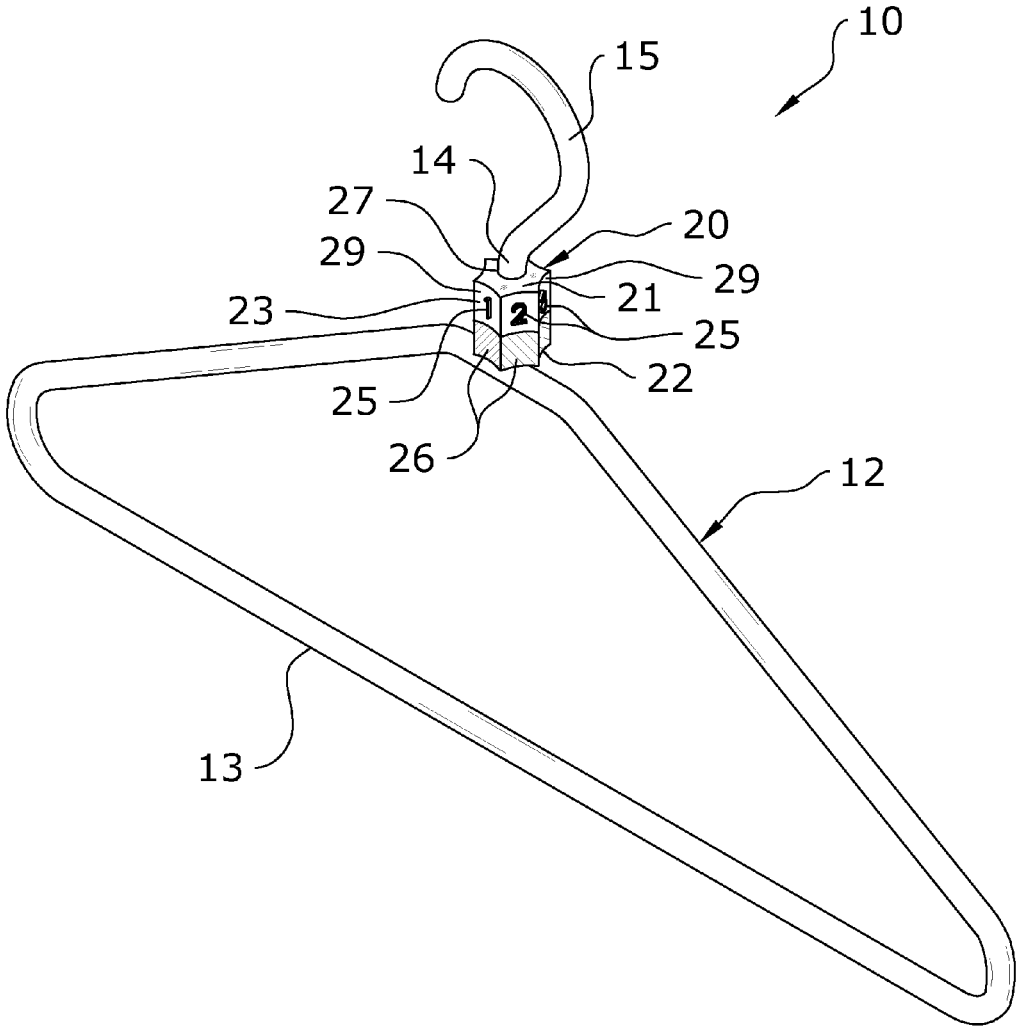
FIG. 1 is an upper perspective view of the present invention installed on a hanger.
Figure 2:
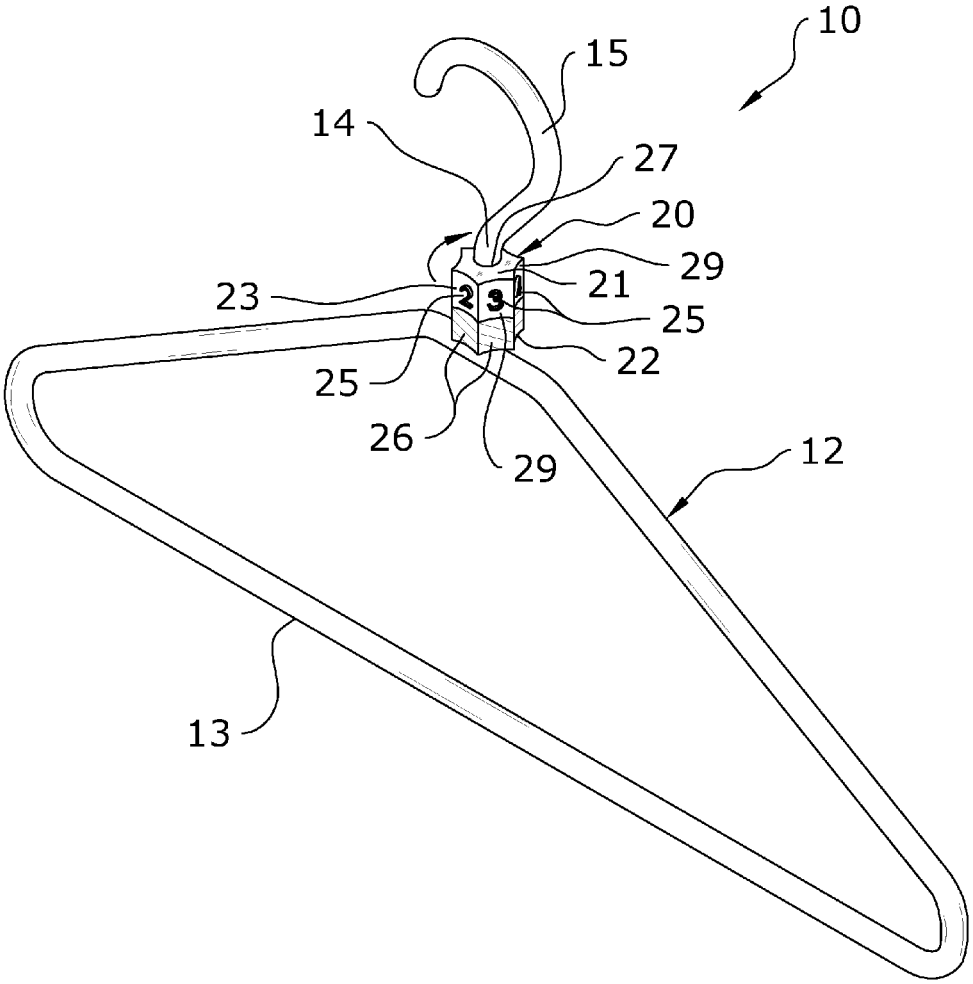
FIG. 2 is an upper perspective view of the present invention being rotated to a different position on the hanger.

Turning now descriptively to the drawings, in which similar reference characters denote similar elements throughout the several views, FIGS. 1 through 23 illustrate a Hanger Accessory Device 10, which comprises a housing 20 having an upper end 21, a lower end 22, and a receiver opening 27 extending therebetween. The upper portion 23 of the outer surface of the housing 20 includes first markings 25 and the lower portion 24 of the outer surface of the housing 20 includes second markings 26. By rotating the housing 20 (and thus the outwardly-facing markings 25, 26) around a stem 14 of a hanger 12, an individual may keep track of how many times an article of clothing has been worn or used between washings.

B. Housing

As shown throughout the figures, the present invention generally includes a housing 20 which is adapted to be positioned around the stem 14 of a hanger 12. The shape, size, and configuration of the housing 20 may vary in different embodiments and should not be construed as being limited by the exemplary figures.

In a preferred embodiment as shown in FIGS. 1-16, the housing 20 comprises an elongated structure having an upper end 21 and a lower end 22. When installed on a hanger 12, the upper end 21 is positioned on the stem 14 near the hook 15 and the lower end 22 is positioned on the stem 14 near the base 13. The length of the housing 20 will vary for different types of hangers 12.

Figure 3:
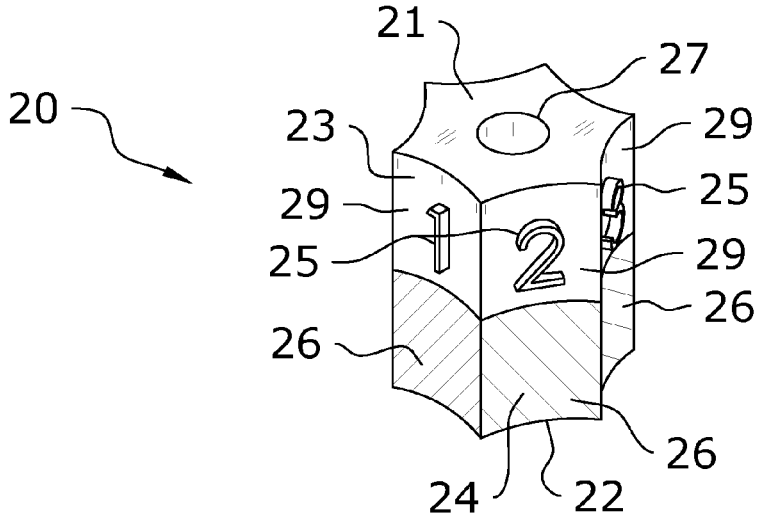
FIG. 3 is an upper perspective view of a housing having curved sides in a first position.
Figure 4:
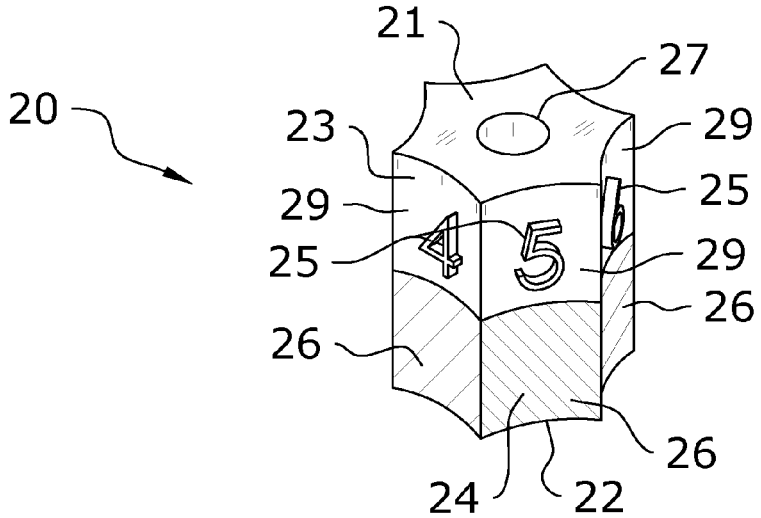
FIG. 4 is an upper perspective view of a housing having curved sides in a second position.
Figure 5:
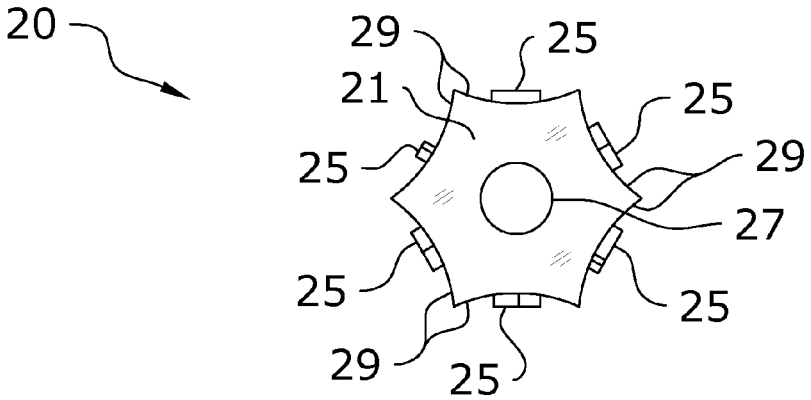
FIG. 5 is a top view of a housing having curved sides of the present invention.
Figure 6:
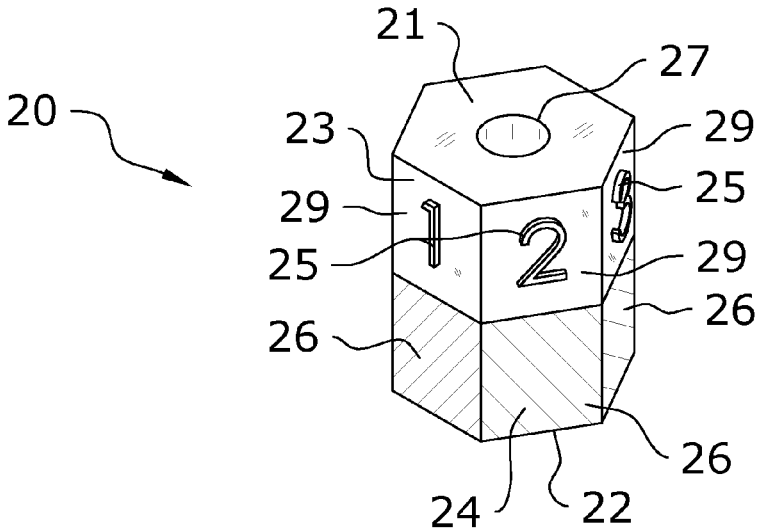
FIG. 6 is an upper perspective view of a housing having flat sides in a first position.
Figure 7:
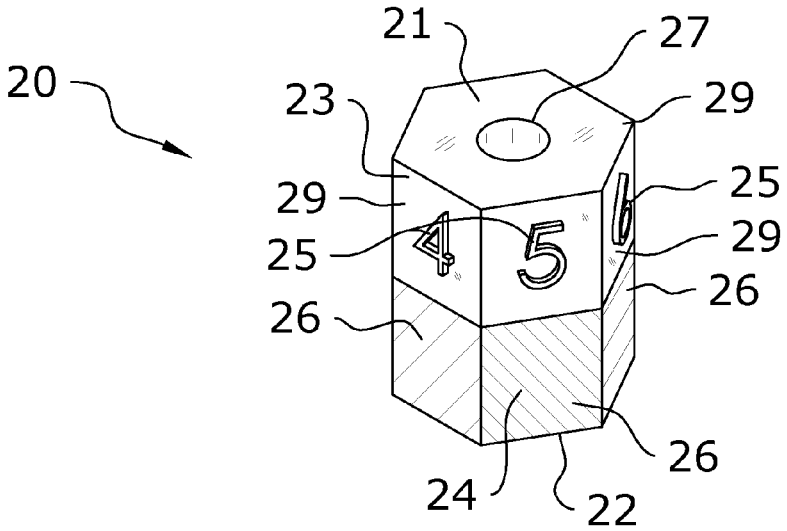
FIG. 7 is an upper perspective view of a housing having flat sides in a second position.
Figure 8:
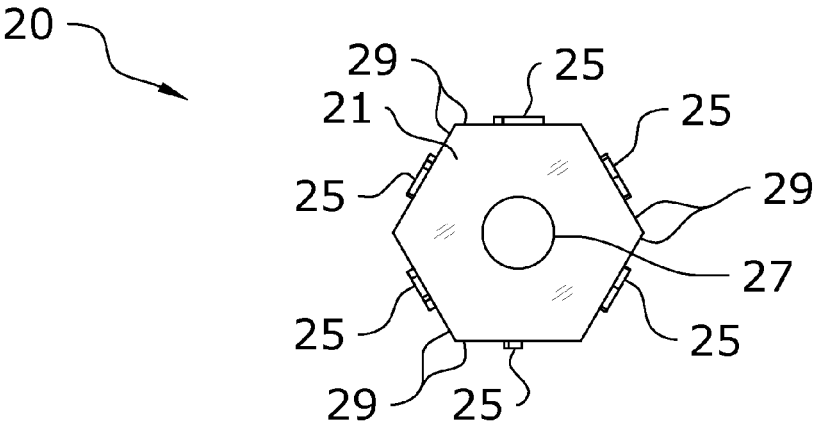
FIG. 8 is a top view of a housing having flat sides.

As best shown in FIGS. 3-5, the housing 20 includes a receiver opening 27 which extends through the housing 20 between its upper and lower ends 21, 22. The stem 14 of the hanger 12 fits within the receiver opening 27 when the present invention is in use. The length and width/circumference of the receiver opening 27 may vary for different embodiments. A slot 28 may extend from the receiver opening 27 as shown in the figures to aid with positioning the stem 14 within the receiver opening 27.

The cross-section of the receiver opening 27 may also vary and need not necessarily be circular. FIGS. 20-23 illustrate an embodiment of the present invention in which the receiver opening 27 comprises a hexagonal cross-section. Such an embodiment works well with hangers 12 having a hexagonal stem 14, as the housing 20 will "click" between multiple positions due to catching on the hexagonal inner surface of the receiver opening 27. This will also prevent the housing 20 from freely rotating about the stem 14.

Figure 12:
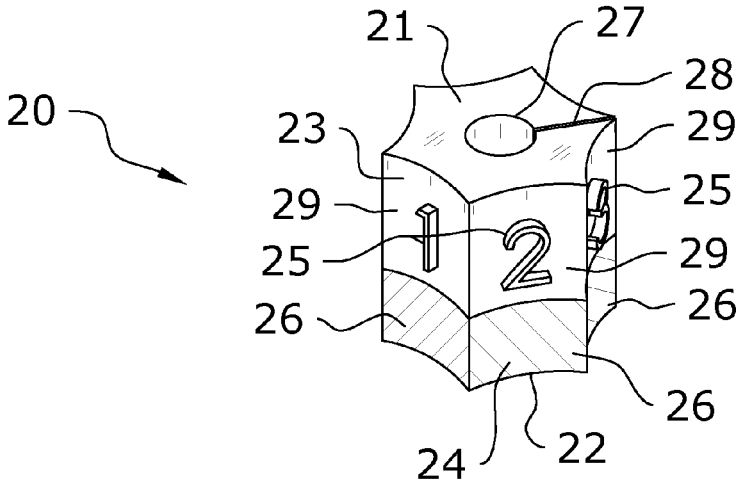
FIG. 12 is an upper perspective view of a housing with a slot in a first position.
Figure 13:
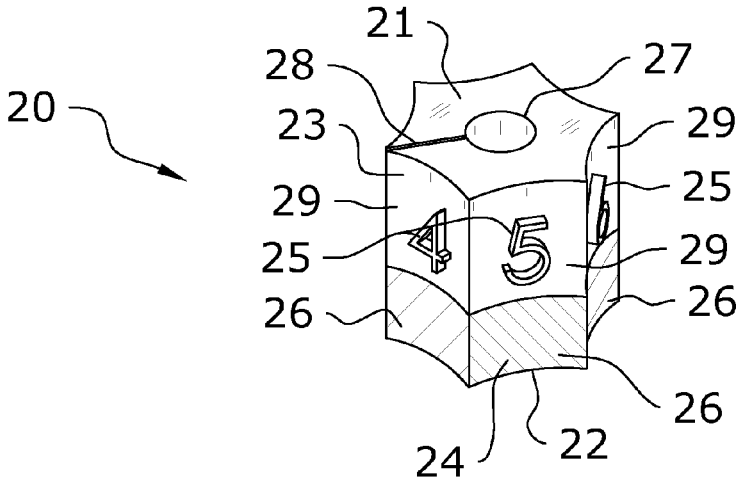
FIG. 13 is an upper perspective view of a housing with a slot in a second position.
Figure 14:
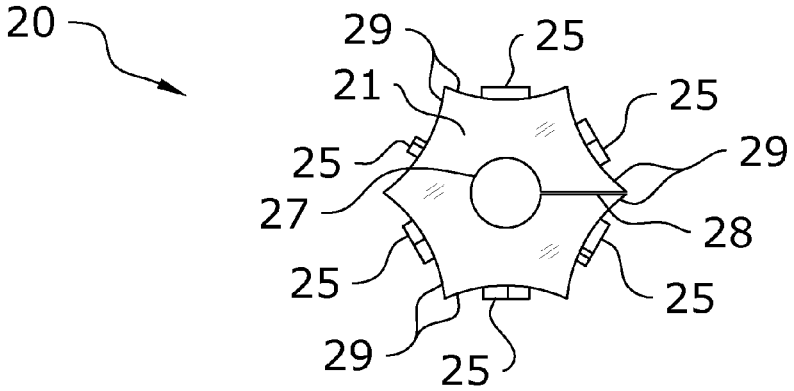
FIG. 14 is a top view of a housing with a slot.
Figure 15:
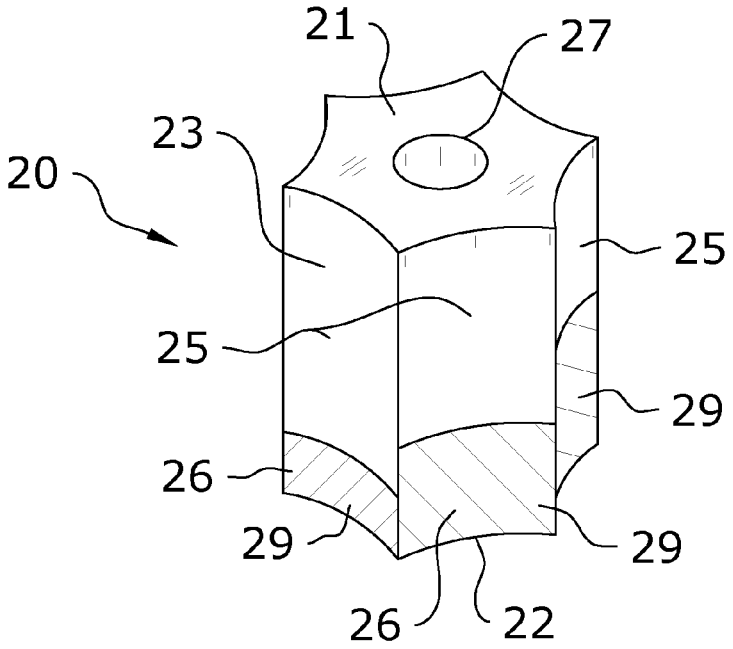
FIG. 15 is an upper perspective view of a housing with upper and lower portions having unequal sizes.
Figure 16:
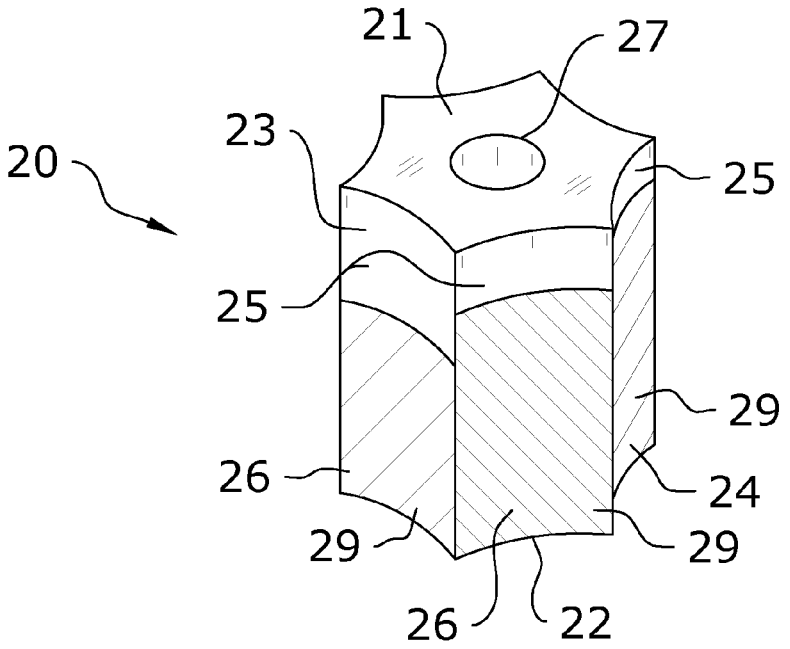
FIG. 16 is an upper perspective view of a second housing with upper and lower portions having unequal sizes.

As shown throughout the figures, the housing 20 is generally separated into an upper portion 23 and a lower portion 24. The upper and lower portions 23, 24 need not be equal in size, so the separation line between the upper and lower portions 23, 24 need not necessarily bisect the housing 20. For example, FIG. 12 illustrates an embodiment in which the upper portion 23 is larger than the lower portion 24. FIG. 15 illustrates an embodiment in which the upper and lower portions 23, 24 are of variable size depending on the side 29 of the housing 20.

As shown throughout the figures, the upper portion 23 generally includes a first marking 25 and the lower portion 24 generally includes a second marking 26. However, it should be appreciated that both portions 23, 24 need not each include markings 25, 26. For example, the upper portion 23 may include a first marking 25 with additional markings 26 being omitted from the lower portion 24.

In a preferred embodiment, the first markings 25 will comprise numbers, letters, or other symbols which can be used to determine previous usage of the hanger 12. As shown in the figures, each side 29 of the housing 20 includes a unique first marking 25, such as sequential numbering as shown in the figures. The first markings 25 may be printed, engraved, or otherwise disposed on the housing 20 through other methods.

The second markings 26 will generally be different from the type used in the first markings 25, though this is not required for proper use of the present invention. For example, if the first markings 25 comprise numbering, the second markings 26 may comprise different shades or colors as shown throughout the figures. It should be appreciated that the second markings 26 may also be numbers, symbols, letters, or the like as well.

Figure 9:
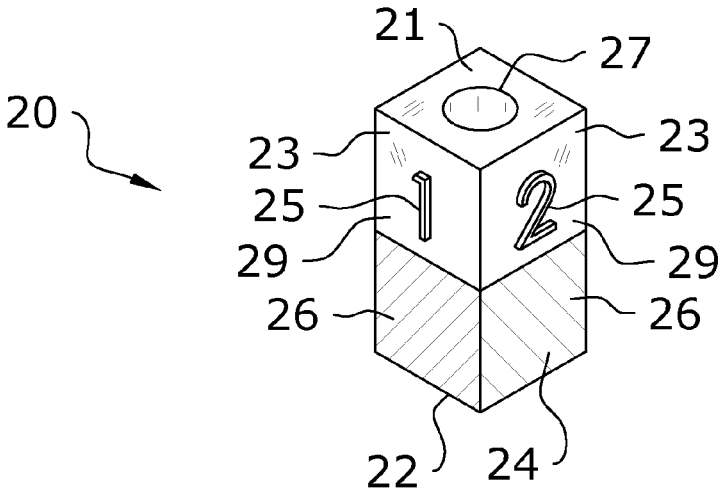
FIG. 9 is an upper perspective view of a four-sided housing in a first position.
Figure 10:
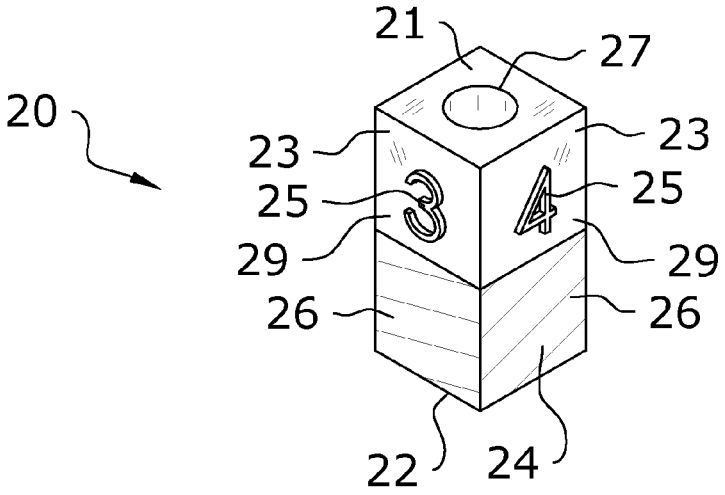
FIG. 10 is an upper perspective view of a four-sided housing in a second position.
Figure 11:
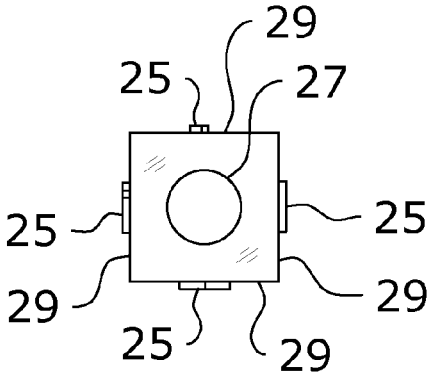
FIG. 11 is a top view of a four-sided housing.

As shown throughout the figures, the housing 20 includes a plurality of sides 29. The number of sides 29 may vary in different embodiments along with the shape of the housing. FIGS. 3-8 illustrate an embodiment with six sides 29. FIGS. 9-11 illustrate an embodiment with four sides 29.

It should also be appreciated that the sides 29 of the housing 20 may be straight-edged as shown in FIG. 9 for example or may be curved-edged as shown in FIG. 3 for example. It should also be appreciated that curved-edge embodiments may have the sides 29 curve inwards or outwards without affecting overall operation of the present invention.

Figure 17:
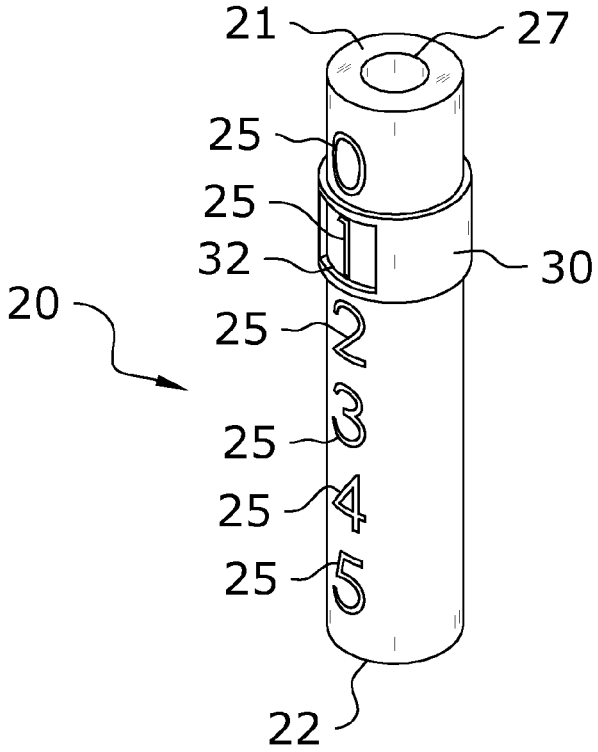
FIG. 17 is an upper perspective view of an alternate embodiment of the present invention.
Figure 18:
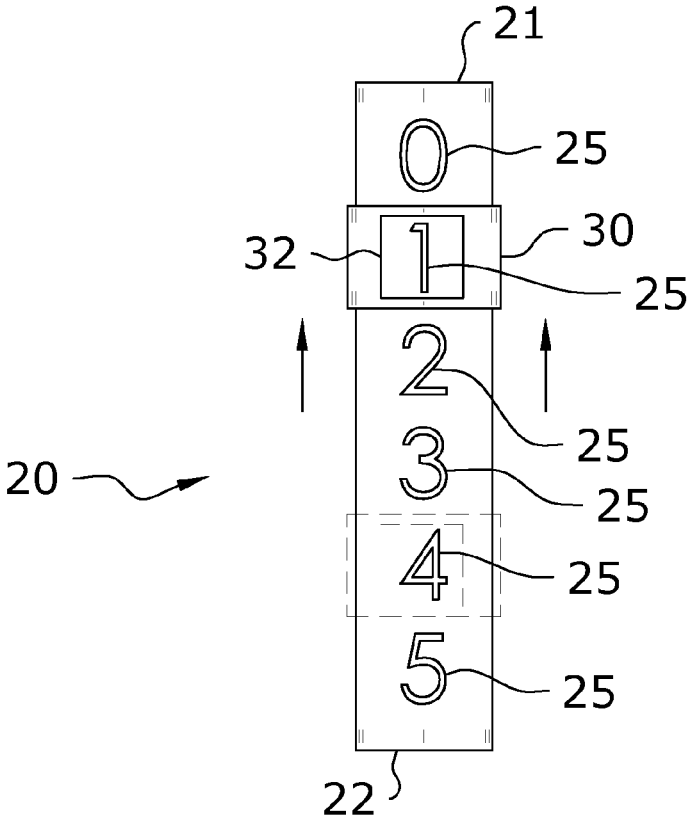
FIG. 18 is a frontal view of an alternate embodiment of the present invention.
Figure 19:
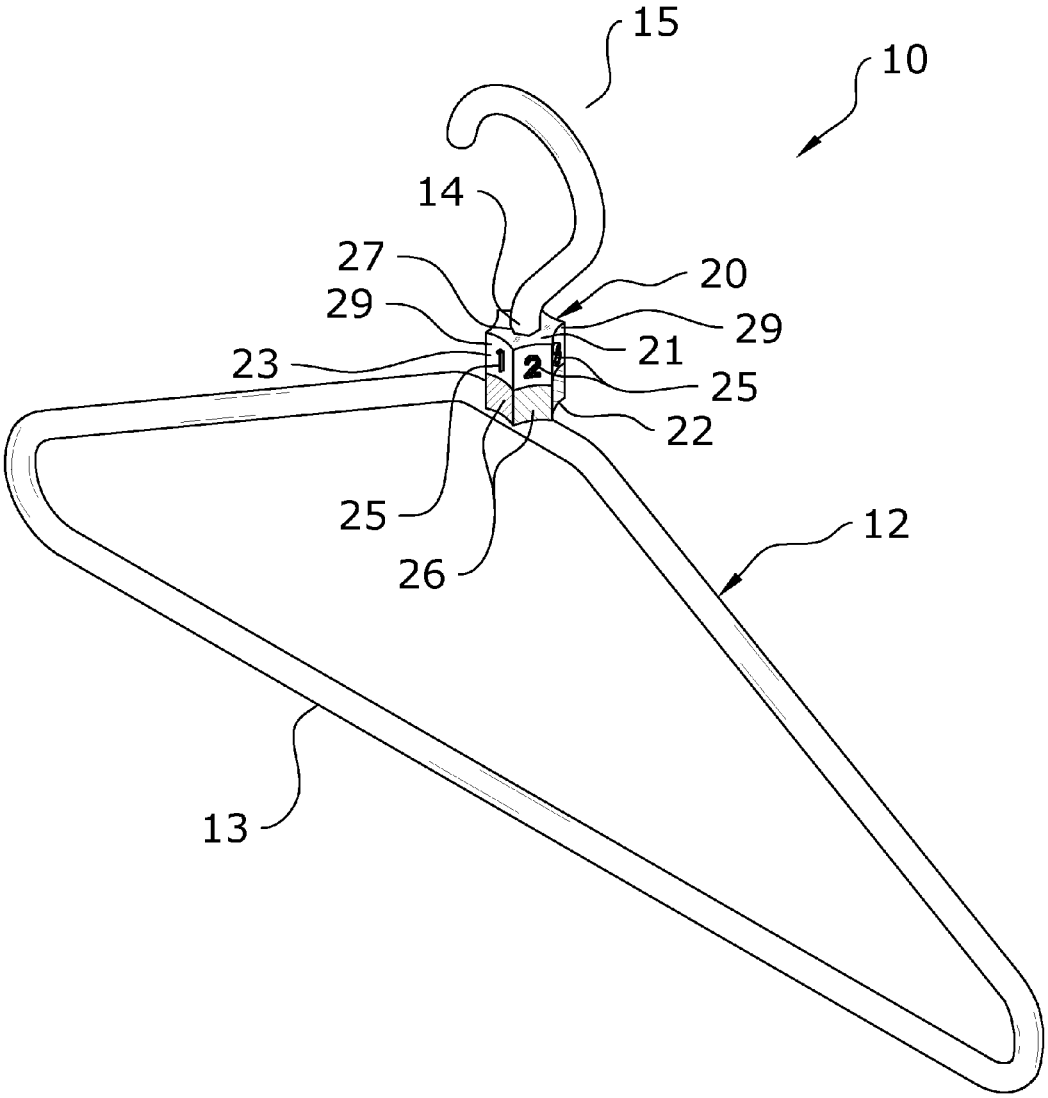
FIG. 19 is an upper perspective view of an embodiment of the present invention with a hexagonal receiver opening.
Figure 20:
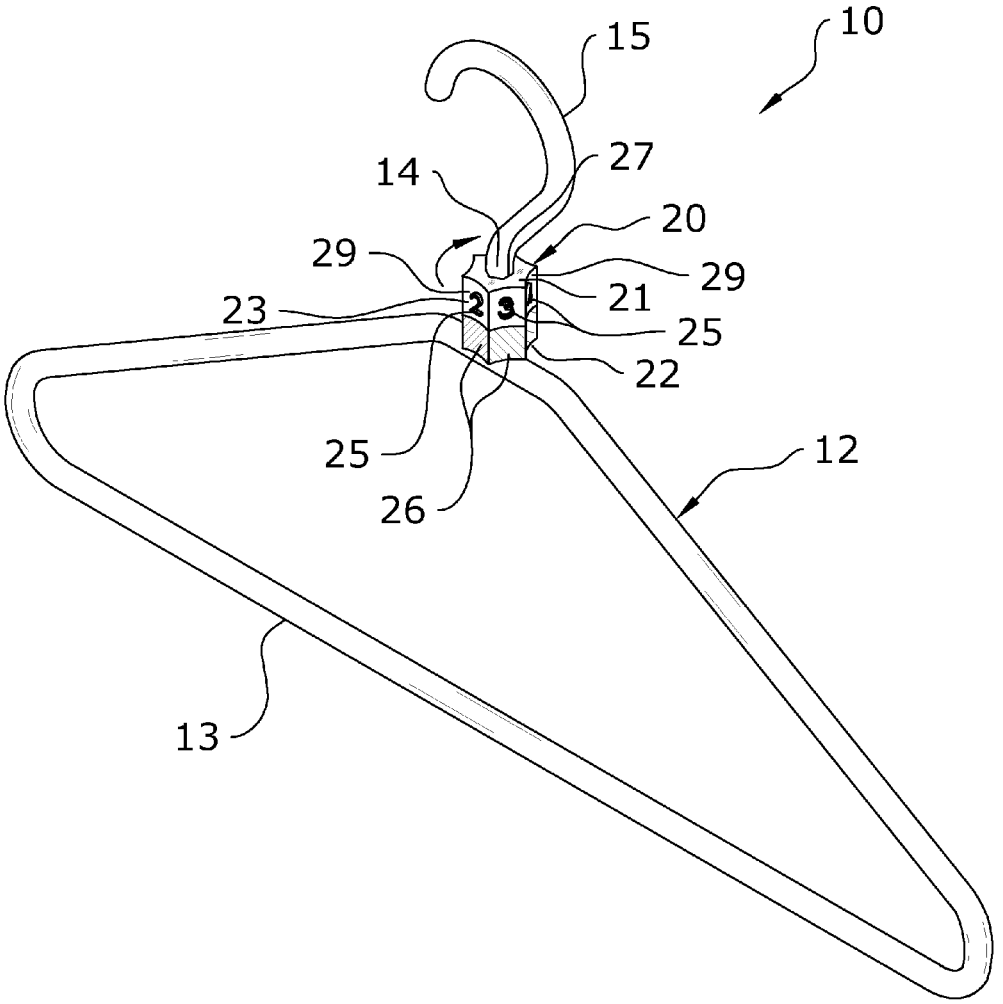
FIG. 20 is an upper perspective view of the hexagonal receiver opening embodiment being rotated along a hanger stem.
Figure 21:
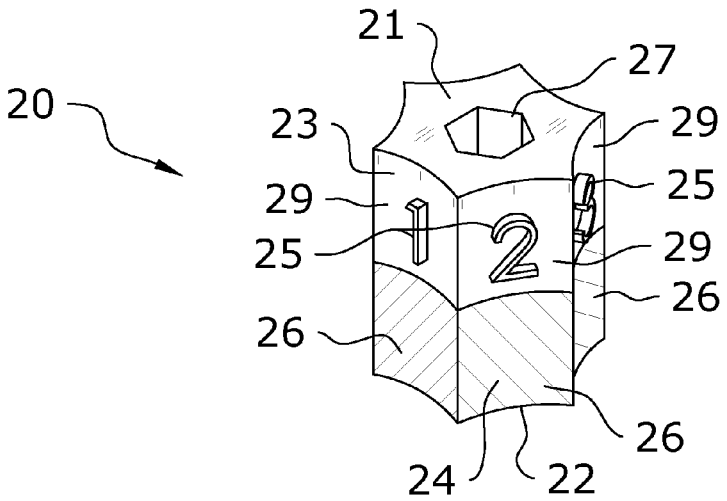
FIG. 21 is an upper perspective view of the housing of an embodiment of the present invention with a hexagonal receiver opening.
Figure 22:
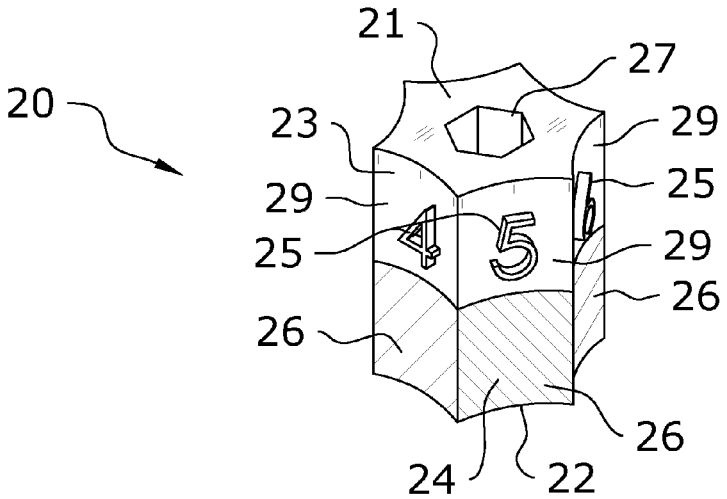
FIG. 22 is a rotated upper perspective of the housing of the hexagonal receiver opening embodiment.

FIGS. 17-18 illustrate an alternate embodiment of the present invention. In this alternate embodiment, the housing 20 comprises a cylindrical tube with a receiver opening 27 extending between its upper and lower ends 21, 22. A plurality of first markings 25 extend along the length of the housing 20 between the two ends 21, 22. The first markings 25 may comprise numbering, lettering, symbols, colors, shading, or the like and need not be vertically-aligned as shown in the figures.

In the alternate embodiment, a selector 30 is provided which is slidably positioned around the housing 20. The selector 30 will preferably slide between the upper and lower ends 21, 22 of the housing 20. The selector 30 is preferably frictionally engaged with the outer surface of the housing 20 to ensure it does not fall completely off and that it stays in the general location of its placement absent any outside force. The selector 30 will preferably include a window 32 through which the underlying markings 25 may be viewed.

C. Operation of Preferred Embodiment

Figure 23:
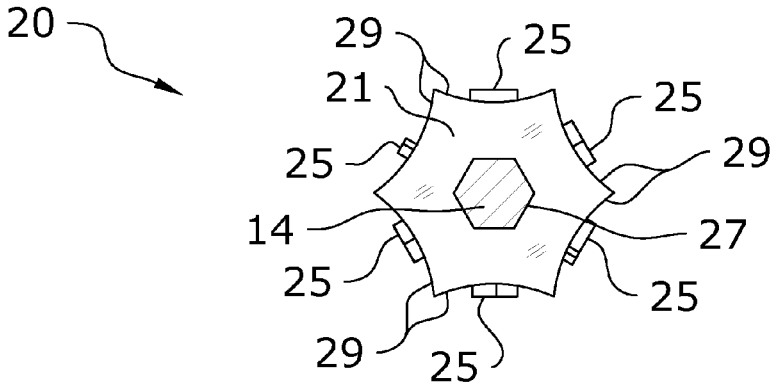
FIG. 23 is a top sectional view of the housing and stem of the hexagonal receiver opening embodiment.

In use, the housing 20 is first installed on the hanger 12. It should be appreciated that the present invention is adapted for use with various types of hangers 12. Generally speaking, a hanger 12 will include a base 13, a stem 14 extending upwardly from the base 13, and a hook 15 extending from the upper end of the stem 14. An exemplary configuration is shown in the figures, though it should be appreciated that a wide range of hanger 12 designs are compatible with the present invention so long as there exists a portion onto which the housing 20 may be installed. For example, a hanger 12 with a hexagonal stem 14 may be utilized in combination with a housing 20 having a hexagonal receiver opening 27 such as shown in FIG. 23.

To install the housing 20 on a hanger 12, the stem 14 of the hanger 12 is positioned within the receiver opening 27 of the housing 20. The housing 20 may be slid down over the hook 15 and onto the stem 14 in embodiments which omit a slot 28 adjacent to the receiver opening 17. In embodiments including such a slot 28, the stem 14 of the hanger 12 may be inserted through the slot 28 to enter the receiver opening 27 to secure the housing 20 around the stem 14.

With the housing 20 secured around the hanger 12 stem 14 as shown in FIG. 1, the present invention is ready for use. An article of clothing may be placed on the hanger 12 and the hanger 12 stored in a closet or other location. Upon retrieving the article of clothing to wear, the user may rotate the housing 20 one step to change which markings 25, 26 are facing outwardly toward the user. Thus, the housing 20 will always give a visual representation of how many times the article of clothing has been worn.

Either the first markings 25, the second markings 26, or a combination thereof may be utilized to indicate how much the article of clothing has been worn. The first markings 25 may include numerical symbols to indicate the number of times the clothing has been worn. The second markings 26 may include colors or other markings to provide the same or different information about the clothing.

This process may be repeated any number of times. Each time the article of clothing is retrieved, the housing 20 may be rotated around the stem 14 to face a different side 28 outwardly and thus expose different markings 25, 26. Upon reaching a set number, the article of clothing may be cleaned and the housing 20 reset to the starting position for the process to be repeated again. Thus, an individual may monitor how many times an article of clothing has been worn prior to cleaning.

For use of the alternate embodiment, the installation process is the same in that the housing 20 is installed on the stem 14 of the hanger 12. Once installed, the selector 30 may be adjusted so that different markings 25 are shown in the window 32. The selector 30 may be adjusted each time the article of clothing is worn until it is cleaned, at which time the selector 30 may be placed at its initial position.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A hanger accessory device, comprising:

a housing including an upper end and a lower end, wherein said housing comprises a hexagonal shape;

a receiver opening extending between said upper end and said lower end of said housing, wherein said receiver opening comprises a hexagonal cross-section;

a plurality of first markings on an outer surface of said housing, wherein each of said first markings is adapted to provide an indicia of prior use of an article of clothing.

2. The hanger accessory device of claim 1, wherein said first markings are comprised of numbers.

3. The hanger accessory device of claim 1, wherein said housing includes an upper portion and a lower portion, wherein said first markings are on said upper portion.

4. The hanger accessory device of claim 3, further comprising a plurality of second markings on said lower portion.

5. The hanger accessory device of claim 4, wherein said first markings are comprised of numbers and wherein said second markings are comprised of different shading.

6. The hanger accessory device of claim 4, wherein said first markings are comprised of symbols and wherein said second markings are comprised of letters.

7. The hanger accessory device of claim 3, wherein said upper portion is larger than said lower portion.

8. The hanger accessory device of claim 1, further comprising a slot extending from said receiver opening.

9. The hanger accessory device of claim 1, further comprising a selector slidably positioned around said housing, wherein said selector is adapted to slide over one of said markings.

10. The hanger accessory device of claim 9, wherein said selector includes a window for viewing said markings beneath said selector.

11. A hanger accessory system, comprising:

a hanger including a hook and a stem extending from said hook;

a housing including an upper end and a lower end, wherein said housing comprises a hexagonal shape;

a receiver opening extending between said upper end and said lower end of said housing, wherein said stem of said hanger extends through said receiver opening, wherein said receiver opening comprises a hexagonal cross-section;

a plurality of first markings on an outer surface of said housing, wherein each of said first markings is adapted to provide an indicia of prior use of an article of clothing.

12. The hanger accessory system of claim 11, wherein said first markings are comprised of numbers.

13. The hanger accessory system of claim 11, wherein said housing includes an upper portion and a lower portion, wherein said first markings are on said upper portion.

14. The hanger accessory system of claim 13, further comprising a plurality of second markings on said lower portion.

15. The hanger accessory system of claim 14, wherein said first markings are comprised of numbers and wherein said second markings are comprised of different shading.

16. The hanger accessory system of claim 14, wherein said first markings are comprised of symbols and wherein said second markings are comprised of letters.

17. The hanger accessory system of claim 13, wherein said upper portion is larger than said lower portion.

18. The hanger accessory system of claim 11, wherein said stem comprises a hexagonal cross-section.

* * * * *